US006565186B1

(12) United States Patent
Hattori et al.

(10) Patent No.: US 6,565,186 B1
(45) Date of Patent: May 20, 2003

(54) INK JET HEAD, INK JET APPARATUS AND METHOD OF RECOVERABLY ACTIVATING IN THE APPARATUS

(75) Inventors: Yoshifumi Hattori, Yamato (JP); Yoichi Tosaka, Yokohama (JP); Mineo Kaneko, Yokohama (JP); Takayoshi Tsutsumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/857,330

(22) Filed: May 16, 1997

Related U.S. Application Data

(63) Continuation of application No. 08/266,686, filed on Jun. 28, 1994, now abandoned.

(30) Foreign Application Priority Data

Jun. 30, 1993 (JP) ..... 5-161987

(51) Int. Cl.[7] ..... B41J 2/165
(52) U.S. Cl. ..... 347/24; 347/30
(58) Field of Search ..... 347/15, 22, 24, 347/30–31, 33, 35, 43, 47, 65; 342/24, 30, 31, 33, 35, 43, 15, 47

(56) References Cited

U.S. PATENT DOCUMENTS

| | | | | | |
|---|---|---|---|---|---|
| 4,313,124 | A | | 1/1982 | Hara | 347/57 |
| 4,345,262 | A | | 8/1982 | Shirato et al. | 347/10 |
| 4,380,771 | A | * | 4/1983 | Takatori | 347/43 |
| 4,459,600 | A | | 7/1984 | Sato et al. | 347/47 |
| 4,463,359 | A | | 7/1984 | Ayata et al. | 347/56 |
| 4,558,333 | A | | 12/1985 | Sugitani et al. | 347/65 |
| 4,646,110 | A | * | 2/1987 | Ikeda et al. | 347/15 |
| 4,723,129 | A | | 2/1988 | Endo et al. | 347/56 |
| 4,728,970 | A | * | 3/1988 | Terasawa | 347/30 |
| 4,740,796 | A | | 4/1988 | Endo et al. | 347/56 |
| 4,908,638 | A | | 3/1990 | Albosta et al. | 347/43 |
| 5,109,233 | A | | 4/1992 | Nishikawa | 347/12 |
| 5,128,690 | A | | 7/1992 | Nozawa | 347/30 |
| 5,157,411 | A | | 10/1992 | Takekoshi et al. | 347/40 R |
| 5,231,424 | A | | 7/1993 | Kaneko et al. | 347/29 |
| 5,298,923 | A | * | 3/1994 | Tokunaga et al. | 347/30 |
| 5,504,508 | A | * | 4/1996 | Hashimoto | 347/24 |

FOREIGN PATENT DOCUMENTS

| | | | | |
|---|---|---|---|---|
| DE | 3412531 | * | 10/1985 | 347/43 |
| EP | 0 444 654 A1 | * | 9/1991 | B41J/2/165 |
| EP | 0 480 302 A1 | * | 4/1992 | B41J/2/05 |
| EP | 0509687 | | 10/1992 | |
| JP | 58-173669 | * | 10/1983 | 347/43 |
| JP | 59-123670 | | 7/1984 | |
| JP | 59-138461 | | 8/1984 | |
| JP | 61-19367 | * | 1/1986 | 347/43 |
| JP | 3-183561 | | 8/1991 | |
| JP | 03-193461 | * | 8/1991 | 347/24 |

* cited by examiner

*Primary Examiner*—Shih-Wen Hsieh
(74) *Attorney, Agent, or Firm*—Fitzpatrick, Cella, Harper & Scinto

(57) ABSTRACT

To reduce a quantity of uselessly consumed ink when an ink jet head is recoverably activated, the capacity of an ink path communicated with a group of ejecting ports having a small flow rate coefficient is determined to be smaller than that of an ink path communicated with a group of ejecting ports having a large flow rate coefficient. While all of plural groups of, ejecting ports are fully covered with a common recovering cap with the aid of sucking means, ink is, sucked from the plural groups of ejecting ports. When the ink remaining in the region extending from the plural groups of ejecting ports to predetermined positions in a plurality of ink paths communicated with the plural groups of ejecting ports is discharged, ink discharging positions are dislocated to predetermined positions in a plurality of ink paths to positionally coincide with the predetermined positions in the substantially same timing relationship after ejection recovering treatment starts to be conducted.

28 Claims, 4 Drawing Sheets

INK JET HEAD, INK JET APPARATUS AND METHOD OF RECOVERABLY ACTIVATING IN THE APPARATUS

This application is a continuation of application Ser. No. 09/266,686 filed Jun. 28, 1994, now abandoned.

BACKGROUND OF THE INVENTION

Field of the Invention

The present invention relates generally to an ink jet head, an ink jet apparatus and a method of recoverably activating in the apparatus.

In the case that the ink jet apparatus is kept unused for a long time or in the case that some specific ejecting ports among a plurality of ejecting ports is rarely used compared with other ejecting ports, there sometimes arises a malfunction that ink is improperly ejected from the ejecting ports. The reason why the foregoing improper ink ejection occurs consists in that water in ink is evaporated from the ejection ports or water in ink is evaporated from an ink chamber communicated with the ejection ports. In addition, there arises another malfunction that some ink droplets, some water droplets or dust particles adhere to the ejection surface of an ink jet head having a plurality of ejecting ports formed thereon, causing each ejected ink droplets to be pulled by the adhered foreign materials with the result that the ejecting direction is deviated from a predetermined one.

To prevent the foregoing malfunction from arising, a conventional ink jet apparatus is equipped with means as noted below to serve as a so-called ejection recovering system. This ejection recovering system is exemplified by e.g., preliminary ejecting means for discharging ink having an increased viscosity in a predetermined ink receiving medium prior to each recording operation, ink sucking means for removing some adhered materials from ejecting ports and a common ink chamber by sucking ink therefrom, ink sucking means for removing air bubbles introduced in ink at the time of ink reservoir replacement, and capping means for preventing water in ink from being vaporized from ejecting ports.

However, the conventional ejection recovering system has some following problems. Specifically, the ink jet apparatus is unavoidably fabricated at an increased cost attributable to necessity for disposing the preliminary ejecting means, the ink sucking means or the capping means. In addition, it is practically difficult to design and construct the ink jet apparatus with small dimensions because of necessity for reserving a space required for disposing the preliminary ejecting means, the ink absorbing means or the capping means. Additionally, it is necessary that an ink reservoir, a suction pump and associated pipings are arranged for executing preliminary ejection or ink suction, and moreover, accumulatively store waste ink in a certain container.

With respect to an ink jet apparatus capable of recording colored images, development works have been hitherto conducted for providing an ink jet apparatus including an ink jet head having plural groups of ejecting ports for black ink, yellow ink, magenta ink and cyan ink formed thereon, ink reservoirs independently disposed corresponding the groups of ejecting ports, a recovering cap common to the ejecting ports, and an ejection recovering unit. This kind of ink jet apparatus is often designed and constructed to record an image colored with two or three kinds of colors other than black. In this case, when a quantity of color ink per one dot is equalized to that of black ink, the diameter of a printed dot recorded on a recording medium is excessively enlarged. In view of the foregoing fact, when each dot is recorded with color ink, the diameter of each injecting port is reduced or the cross-sectional area of an injection nozzle is reducibly varied. To practice a so-called bubble jet recording system for ejecting liquid droplets by heating electrothermal transducers, a measure is taken such that a surface area of each heating elements is reduced or a distance between the heat generating element and an ejection orifice is changed to another one.

An ink jet apparatus using plural kinds of inks each having a different color and/or different depth of color employed therefor includes an ink jet head or an ink jet head unit having plural groups of ejecting ports formed therein, and the nozzle cross-sectional area of each ejecting port among a group of ejecting ports and the diameter of the same each varies from plural groups of ejecting ports. In addition, this ink jet apparatus includes an ejection recovering unit but this ejection recovering unit has the following shortages. Specifically, in the case that a magnitude of resistance against flowing of ink differs from each of plural groups of ejection ports and a sucking operation is achieved by a common recovering cap, a quantity of ink sucked by a single recovering operation each varies from plural groups 23 of ejecting ports. Consequently, a large quantity of ink is sucked by each ejection port among a group of ejecting ports having a large flow rate coefficient but a small quantity of ink is sucked by each ejection port among a group of ejecting ports having a small flow rate coefficient. If a quantity of ink sucked by each ejecting port during each sucking operation each varies from plural groups of ejecting ports, ink should be sucked from plural groups of ejecting ports in such a manner as to match with the quantity of ink sucked by the group of ejecting ports where a magnitude of resistance against flowing of ink is maximized, in order to remove air bubbles introduced in ink at the time of ink reservoir replacement or discharge ink having an increased viscosity in an ink path. For this reason, a quantity of ink in excess of a required quantity is sucked from other groups of ejecting ports and then uselessly wasted therefrom.

A flow rate coefficient of plural groups of ejection ports adapted to eject plural kinds of inks each having a different kind of color and/or different depth of color is substantially determined depending on a sum of the cross-sectional area of each ejecting ports involved in each of plural groups of ejecting ports. Obviously, the sum of the cross-sectional area of all the ejecting ports is determined based on the cross-sectional area of each ejecting port and the number of ejecting ports. Thus, in the case that plural groups of ejecting ports each having a different flow rate coefficient are subjected to ejection recovering treatment by utilizing the pressure in the fully capped state in consideration of the current technical tendency for reducing the number of components constituting the ink jet apparatus and simplifying the structure of the ink jet apparatus, the aforementioned malfunctions are liable to arise.

SUMMARY OF THE INVENTION

The present invention has been made in consideration of the aforementioned background.

An object of the present invention is to provide an ink jet head for an ink jet apparatus which assures that a quantity of uselessly consumed ink when the ink jet head is recoverably activated can be reduced.

Another object of the present invention is to provide an ink jet apparatus in which an ink jet head of the foregoing type is installed.

Further object of the present invention is to provide a method of recoverably activating an ink jet apparatus of the foregoing type.

According to a first aspect of the present invention, there is provided an ink jet head including plural groups of ejecting ports each having a different flow rate coefficient, wherein a capacity of an ink path communicated with a group of ejecting ports having a small flow rate coefficient is smaller than that of an ink path communicated with a group of ejecting ports having a large flow rate coefficient.

In addition, according to a second aspect of the present invention, there is provided an ink jet apparatus having an ink jet head of the foregoing type installed therein, wherein the ink jet head includes plural groups of ejecting ports each having a different flow rate coefficient in such a manner that a capacity of an ink path communicated with a group of ejecting ports having a small flow rate coefficient is smaller than that of an ink path communicated with a group of ejecting ports having a large flow rate coefficient, and sucking means is arranged for sucking ink from the plural group of ejecting ports in the state that the latter are fully covered with a common recovering cap.

Additionally, according to a third aspect of the present invention, there is provided a method of recoverably activating an ink jet apparatus including plural groups of ejecting ports each having a different flow rate coefficient by utilizing the pressure applied to the ejecting ports, all the plural groups of ejecting ports being subjected to ejection recovering treatment, wherein the method comprises a step of discharging the ink remaining in the region extending from the plural groups of ejecting ports to predetermined positions in a plurality of ink paths communicated with the plural groups of ejecting ports and a step of allowing ink discharging positions to be dislocated to the predetermined positions in the plurality of ink paths to positionally coincide with the same in the substantially same timing relationship after the ejection recovering treatment starts to be conducted. In other words, a characterizing feature of this method consists in that limitative positions where ink is discharged from an ink path including a common ink chamber communicated with ejecting ports involved in a certain group of ejection ports on the common basis and an ink feeding path from which ink is fed to the common ink chamber are substantially positionally coincident with each other among plural groups of ejection ports.

With this construction, e.g., the ink remaining in the ink path extending from the ejecting ports to a joint portion between the ink feeding path and the ink chamber is discharged in the substantially same timing relationship after the ejection recovering treatment starts to be conducted. Otherwise, e.g., the ink remaining in the region extending from the ejecting ports to the joint portion between the ink path and an ink reservoir is discharged in the substantially same timing relationship.

In this case, according to the present invention, since the ink reservoir usually has a comparatively large capacity, the aforementioned technical problem does not substantially arise with the ink reservoir. Therefore, it is not necessary that the foregoing part of the ink reservoir is involved in the ink path of the present invention.

The ink reservoir serving to feed ink to the ink reservoir can be integrated with the ink jet head. Otherwise, the ink reservoir can be arranged so as to be separated from the ink jet head. It is acceptable that partitioning means for partitioning a group of ejecting ports having a different flow rate coefficient from each other is disposed in the recovering cap.

According to the present invention, since a sum of the capacity of the ink feeding path and the capacity of the common chamber is determined depending on the flow rate coefficient of each nozzle, ejection recovering treatment can reliably be conducted for each of the group of ejection ports by performing an ejection recovering operation with the aid of a single recovering cap, whereby a quantity of ink to be uselessly wasted during each ejection recovering operation can be reduced. In other words, a small quantity of ink to be sucked during each ejection recovering operation is discharged from a group of ejecting ports having a small nozzle flow rate coefficient, and moreover, a quantity of ink required for removing air bubbles in ink having an increased viscosity can be reduced. Thus, it is possible to recoverably activate the ink jet head without fail.

The above and other objects, effects, features and advantages of the present invention will become apparent from the following description which of embodiments thereof taken in conjunction with the accompanying drawings.

DESCRIPTION OF THE PREFERRED EMBODIMENTS

The present invention will now be described in detail hereinafter with reference to FIG. 1 to FIG. 5 which illustrate preferred embodiments thereof.

Figure 2:
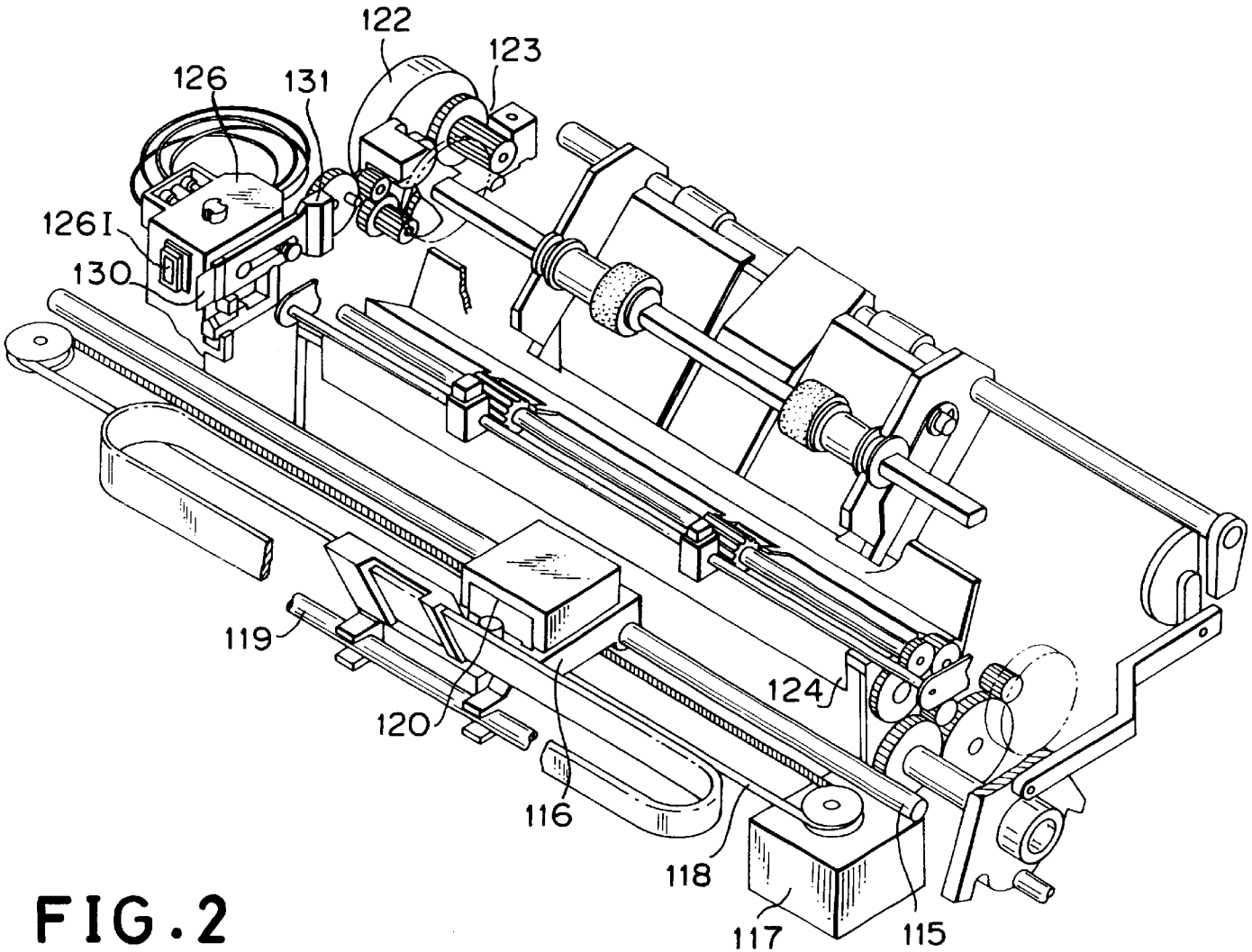
FIG. 2 is a perspective view of the ink jet recording apparatus to which the present invention is applied, showing by way of example an appearance of the ink jet recording apparatus.

FIG. 2 is a perspective view of an ink jet recording apparatus to which the present invention is applied, showing that a cartridge type ink jet head is installed in the ink jet recording apparatus.

As shown in FIG. 2, an ink jet head 120 is mounted on a carriage 116. This ink jet head 120 includes plural arrays of nozzles 103*b*, 103*c*, 103*m* and 103*y* each of which serves to eject ink to the recording surface of a recording paper conveyed by a platen 124 while facing to the latter. The carriage 116 is supported by two guide shafts 115 and 119 extending in parallel to each other so as to enable it to be slidably displaced along the guide shafts 115 and 119. The carriage 116 is operatively connected to a part of an endless driving belt 118 for transmitting the driving power generated by a driving motor 117 to the carriage 116. In addition, the carriage 116 is arranged in such a manner as to enable the ink jet head 120 to be reciprocably displaced within the range defined by the full width of the recording paper.

The ink jet recording apparatus includes an ejection recovering unit 126 which is disposed at the position located to one end of the displacement path of the ink jet head 120, e.g., a home position of the latter. The ejection recovering unit 126 performs a capping operation for the ink jet head 120 via a power transmitting mechanism 123 adapted to transmit the driving power generated by a motor 122 to the ejection recovering unit 126. The ejection recovering unit 126 includes a recovering cap 126I which serves to suck ink from the ink jet head 120 during a capping operation performed for the ink jet head 120 with the aid of suitable sucking means disposed in the ejection recovering unit 126 or pump ink to the ink jet head 120 with the aid of suitable pressuring means disposed in an ink path in order to forcibly discharge (expel) ink from a plurality of ejecting ports 111. With this construction, the ejection recovering unit 126 executes ejection recovering treatment for removing the ink having an increased viscosity from each nozzle 103. It should be added that the ink jet head 120 is protected from deterioration of its performances by performing a capping operation for the ink jet head on completion of each recording operation.

A blade 130 for a wiping member molded of a silicone rubber or the like is disposed on the side wall of the ejection recovering unit 126. This blade 130 is held by a blade holding member 131 in the cantilever-like state. Similar to the ejection recovering unit 126, the blade 130 is actuated by the motor 122 and the power transmitting mechanism 123. The blade 130 can come in slidable contact with an ejection surface of the ink jet head 120. Specifically, the blade 130 is projected into the displacement path of the ink jet head 120 at a suitable time during a recording operation performed by the ink jet head 120 or after completion of the ejection recovering treatment in order to remove dew, moisture, dust particles on the ejection surface of the ink jet head 120 by a wiping operation of the blade 130 performed as the ink jet head 120 is reciprocably displaced in that way.

Figure 3:
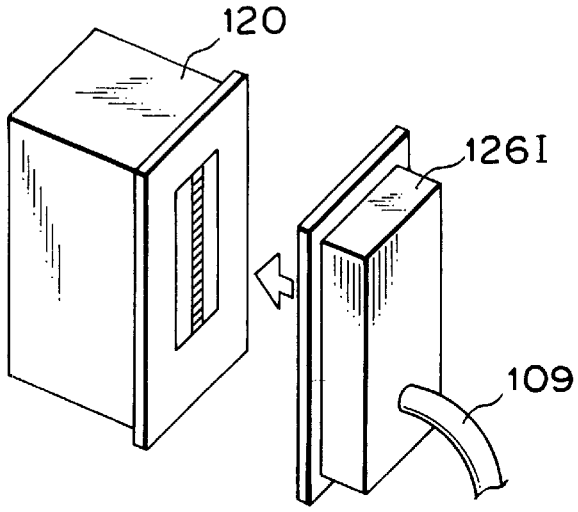
FIG. 3 is a perspective view which shows an appearance of each of the ink jet head and a recovering cap.

FIG. 3 is a perspective view which shows an appearance of each of the ink jet head 120 and the recovering cap 126I. In the case that the ink jet head 120 is kept unused for a long time, resulting in the viscosity of ink in the nozzles 103*b*, 103*c*, 103*m* and 103*y* and in common ink chambers 104*b*, 104*c*, 104*m* and 104*y* being increased or in the case that air bubbles introduced into the ink jet head 120 from a joint portion at the time of replacement of an ink reservoir 112 with another one are removed from the ink jet head 120, the recovering cap 126I comes in close contact with the ejection surface of the ink jet head 120. Subsequently, a pump (not shown) is driven to suck ink from the ink jet head 120, causing the latter to be subjected to ejection recovering treatment. At this time, a small quantity of ink is sucked from color ink nozzles 103*c*, 103*m* and 103*y* each having a small flow rate coefficient compared with black ink nozzle 103*b*. However, since common ink chambers 104*c*, 104*m* and 104*y* and ink feeding paths 106*c*, 106*m* and 106*y* from which ink is sucked have a small inner capacity, respectively, it is possible to recover not only the black nozzle 103*b* but also the color ink nozzles 103*c*, 103*m* and 103*y* by performing the same recovering operations as mentioned above.

On the assumption that a differential pressure is designated by p, a cross-sectional area of the nozzle 103 is designated by F, a density of ink is designated by ρ and a flow rate of ink is designated by Q, a flow rate coefficient of the nozzle 103 designated by α is represented by the following equation (1).

$$\alpha = Q/\{F\cdot(2p/\rho)^{1/2}\} \quad (1)$$

When a sum of the inner capacity of the common ink chamber 104, the inner capacity of each ink feeding path 106 and the inner capacity of the nozzle 103 is designated by S, it is necessary that the condition as defined by an inequality of Q>S is satisfactorily established.

Figure 1:
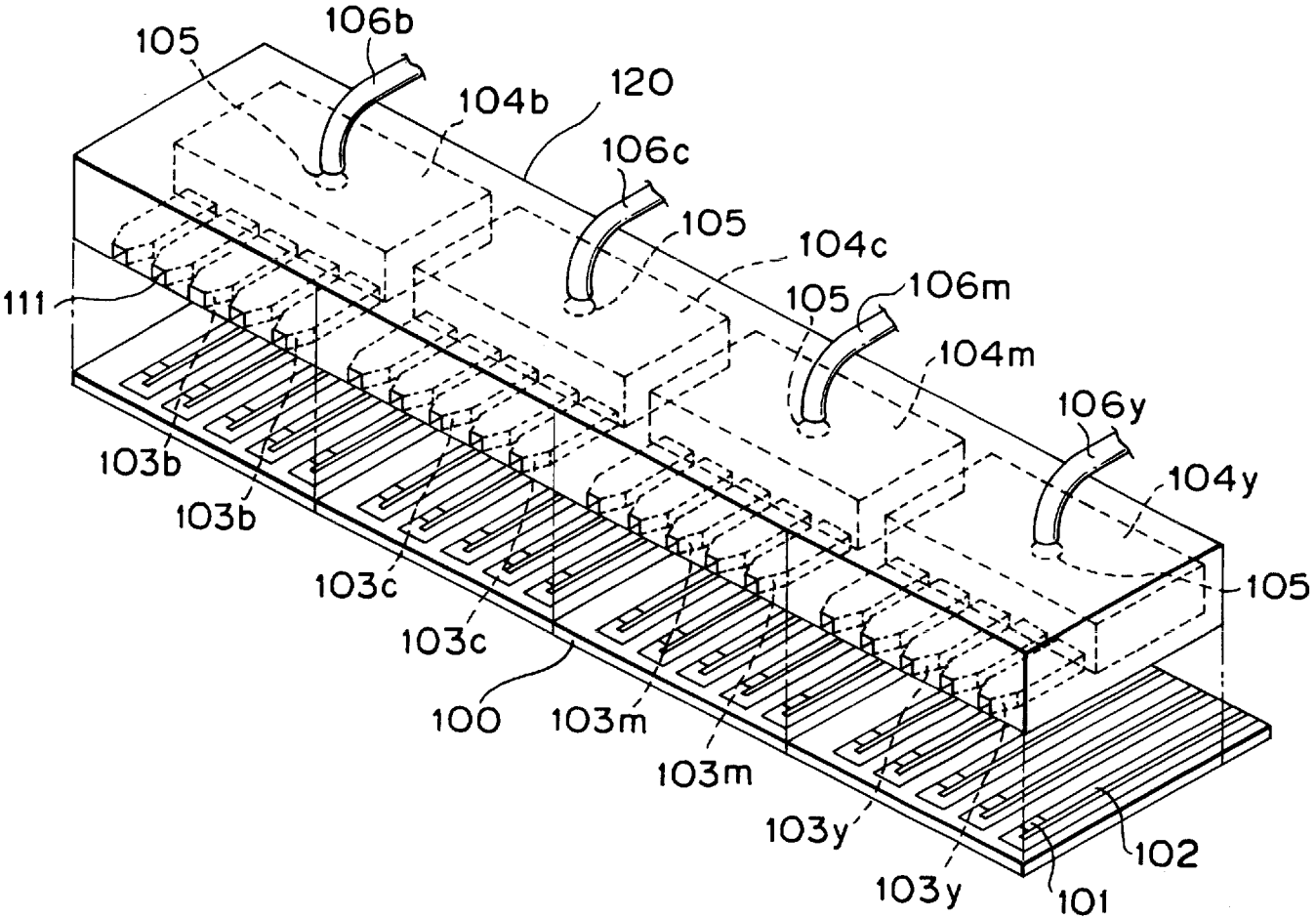
FIG. 1 is a perspective view of an ink jet head constructed in accordance with an embodiment of the present invention, showing the ink jet head constituting a part of an ink jet recording apparatus in the exploded state.

FIG. 1 is a partially exploded perspective view which shows the structure of an ink jet head 120 constructed in accordance with an embodiment of the present invention. This ink jet head 120 is constructed such that a plurality of heat generating resistors 101, a plurality of electrodes 102 and a plurality of protective layers (not shown) are successively laminated one above another by employing a spattering process, a CVD process, an electron beam irradiating process or the like, and thereafter, the nozzle 103 and the common ink chambers 104 are formed by employing a photoetching process. An ink feeding port 105 is formed through a ceiling plate of each common ink chamber 104. Ink is fed to each common ink chamber 104 from an ink reservoir 112 via an ink feeding path 106 communicated with the ink feeding port 105. In the shown case, the ink jet head 120 includes four common ink chambers 104*b*, 104*c*, 104*m* and 104*y* which are communicated with ink reservoirs 112 for black ink, cyan ink, magenta ink and yellow ink. Thus, each different colored inks are ejected from nozzles 103*b*, 103*c*, 103*m* and 103*y* communicated with the four common ink chambers 104*b*, 104*c*, 104*m* and 104*y*. Especially, the nozzle 103*b* is used for ejecting black ink therefrom. This black ink nozzle 103*b* is designed to eject a liquid droplet having a volume larger than that of each of the other color ink nozzles 103*c*, 103*m* and 103*y*. For example, an ink jet head 120 capable of recording 360 dots per inch (d.p.i.) is employed for practicing this embodiment, and a volume assumed by each liquid droplet of black ink ejected from the ink jet head 120 is determined to range from about 65 to 95 pico liters (p.l.), preferably from about 75 to 85 p.l. On the other hand, a volume assumed by a liquid droplet of each of cyan ink, magenta ink and yellow ink ejected from the same is determined to range from 30 to 50 p.l., preferably 32 to 45 p.l. in consideration of shooting of liquid droplets onto a recording medium in the overlapped state. An example of dimensions employed for designing each nozzle 103 advantageously usable for ejecting liquid droplets each having the foregoing volume is shown in Table 1.

TABLE 1

| color of ink | dimensions of heater unit : μm | dimensions of each nozzle 103 (width × height × length) unit : μm | dimensions of ejection port (width × height) unit : μm | number of nozzles 103 |
|---|---|---|---|---|
| black | 40 × 100 | 55 × 33 × 300 | 35 × 33 | 64 |
| color | 20 × 105 | 50 × 33 × 300 | 25 × 33 | 24 for each color |

Figure 4:
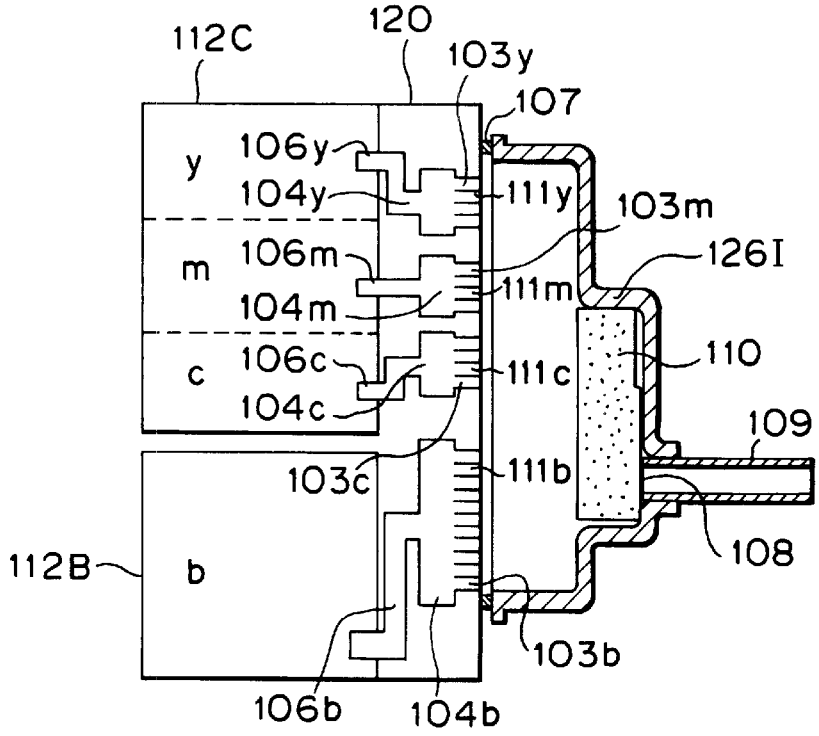
FIG. 4 is a sectional view of the ink jet head, showing that the latter is held in the capped state.

FIG. 4 is a schematic sectional view which shows the state that the ink jet head 120 shown in FIG. 1 is capped with the recovering cap 126. An inner capacity of each of the common color ink chambers 104*c*, 104*m* and 104*y* is set to about 3 $mm^3$. An inner capacity of the common ink chamber 104*b* for black ink is set to about 7.5 $mm^3$. An inner capacity of each of color ink feeding paths 106*c*, 106*m* and 106*y* for feeding color inks to the common ink chambers 104*c*, 104*m* and 104*y* from the color ink reservoir 112C is set to 1.8 $mm^3$. In addition, an inner capacity for the black ink feeding path 106*b* is set to 3.6 $mm^3$. Additionally, foreign material trapping means for trapping dust particles, air bubbles or the like may be disposed at the intermediate position of each ink feeding path 106 or at one end of the same.

To assure that the recovering cap 126I elastically comes in close contact with the outer edge of the ejecting surface of the ink jet head 120, it is molded of a rubber-like elastic material such as a silicone rubber or the like. A rectangular rib having a width of about 0.3 mm is projected from the front surface of the recovering cap 126I in order to improve the close contact state between the ink jet head 120 and the recovering cap 126I when the whole ejection surface of the ink jet head 120 is covered with the ink jet head 120. In addition, a suction hole 108 is formed through the recovering cap 126I. A suction tube 109 is connected to the suction hole 108. A waste ink absorbing block 110 is disposed in front of the suction hole 108. This waste ink absorbing block 110 serves to absorb the ink droplets remaining in the recovering cap 126I. The ink jet head 120 includes a plurality of ejection ports 111*y*, 111*m*, 111*c* and 111*b* which are arranged in accordance with the order of yellow ink, magenta ink, cyan ink and black ink as seen from above in FIG. 4. A distance between adjacent arrays of nozzles among plural arrays of nozzles 103*y*, 103*m*, 103*c* and 103*b* is set to be wider than a normal nozzle pitch. The suction tube 109 is connected to a pump (not shown).

In this embodiment, the ink reservoir 112 is designed in a two-reservoir system composed of a black ink reservoir 112B and a color ink reservoir 112C. The interior of the color ink reservoir 112C is divided into three sections, one of them being a section for cyan ink, other one being a section for magenta ink and another one being a section for yellow ink. The color ink reservoir 112C may be designed to exhibit an integral structure like in this embodiment. Otherwise, it may be designed in a separate type including a plurality of sections separated from each other corresponding to the number of ink colors. Usually, the ink reservoirs 112 are mounted on the carriage 116 together with the ink jet head 120. Otherwise, these ink reservoirs 112 are arranged independently from the carriage 116, and the ink reservoirs 112 and the ink jet head 120 are connected to each other via ink feeding tubes extending therebetween.

The foregoing embodiment has been described above with respect to the ink jet head 120 including plural arrays of nozzles 103 mounted on a common base plate 100. Alternatively, the plural arrays of nozzles 103 may distributively be formed on a plurality of base plates.

Figure 5:
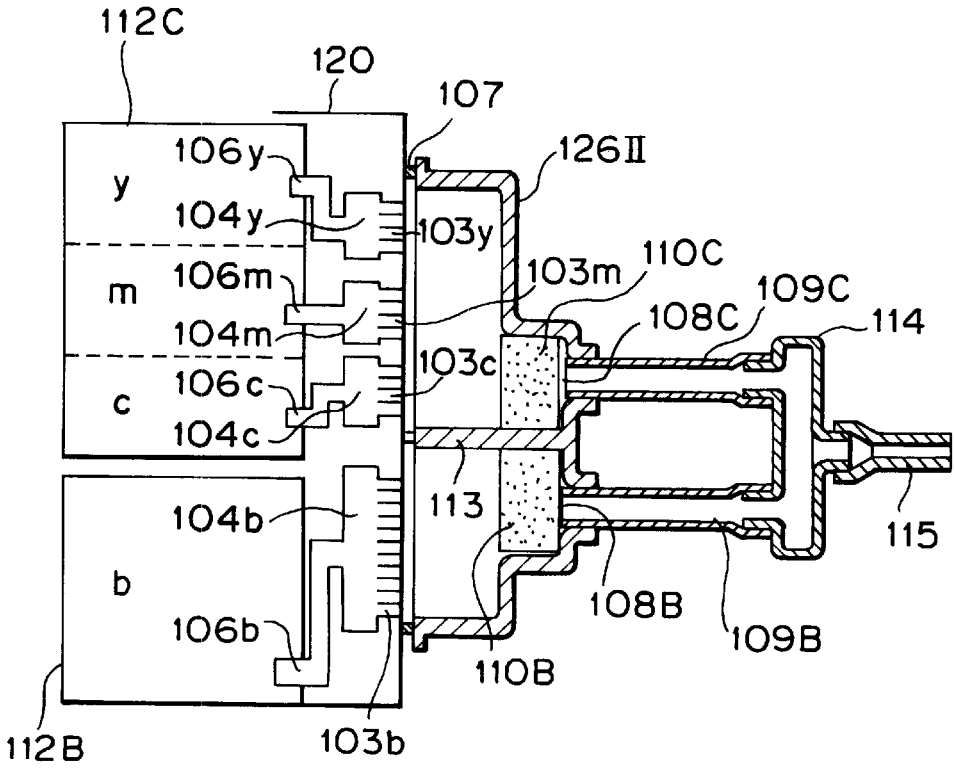
FIG. 5 is a sectional view of an ink jet head constructed in accordance with another embodiment of the present invention wherein the ink jet head constitutes a part of the ink jet recording apparatus.

FIG. 5 is a sectional view which shows an ink jet head constructed in accordance with another embodiment of the present invention.

In this embodiment, the ink jet head includes a recovering cap 126II which is divided into a cap portion for color inks and a cap portion for black ink with a partition rib 113 disposed therebetween. Suction holes 108B and 108C communicated with suction tubes 109B and 109C are formed through the foregoing two cap portions. Waste ink absorbing blocks 110B and 110C are disposed in front of the suction holes 108B and 108C. Each of the waste ink absorbing blocks 110B and 110C serves to absorb the ink droplets remaining in the recovering cap 126II. The suction tubes 109B and 109C are connected to a common pump (not shown) via an adapter 114 and a pump tube 115 extending between the adapter 114 and the pump. The partition rib 113 is effective not only for preventing black ink and color inks from being mixed with each other but also for preventing other kind of ink from entering the nozzle 103. It desirable that the partition rib 113 in the recovering cap 126II exhibits a complete partitioning function. It should be noted that the partition rib 113 is practically effective for preventing inks from being mixed with each other even though it exhibits an insufficient partitioning effect.

Also with respect to the recovering cap 126II constructed in the above-described manner, a quantity of ink ejected from each of the color ink nozzles 103*c*, 103*m* and 103*y* each having a small flow rate efficient is small compared with that of the black ink nozzle 103*b*. However, since an inner capacity of each of the common color ink chambers 104*c*, 104*m* and 104*y* and the color ink feeding paths 106*c*, 106*m* and 106*y* each having necessity for sucking ink from the former is designed to be correspondingly small, it is possible to recoverably activate not only the black ink nozzle 103*b* but also the color ink nozzles 103*c*, 103*m* and 103*y* every time suction recovering treatment is executed.

Especially, among various types of ink jet recording systems, the ink jet head constructed in accordance with this embodiment exhibits advantageous effects when it is employed for a recording head and a recording apparatus each operable in accordance with an ink jet system wherein jetting liquid droplets are formed by utilizing thermal energy to perform a recording operation therewith.

With respect to a typical structure and a principle of operation of the ink jet recording system, it is recommendable that reference is made to U.S. Pat. Nos. 4,723,129 and 4,740,796 each of which discloses the fundamental principle of the foregoing system. This system is applicable either of a so-called on-demand type and a continuous type. Especially, in the case that the on-demand type is employed, thermal energy is generated in each electrothermal transducer by applying at least one driving signal to the electrothermal transducer disposed corresponding to a sheet of porous material or a liquid passage having ink received therein so as to quickly elevate the present temperature in excess of a level of inducing a phenomenon of nuclear boiling based on the recording informations, causing a phenomenon of film boiling to appear on the heating portion of an ink jet head. This leads to a desirable result that an ink vapor bubble is formed in ink in the one-to-one relationship in response to a driving signal. As the ink vapor bubble thermally grows and contracts, ink is ejected through an ejection port to form at least one liquid droplet. Since the ink vapor bubble is adequately grown and contracted when the driving signal is prepared in the form of a pulse, the ink can be ejected from the ink jet head with excellent responsiveness.

With respect to the pulse-shaped driving signal, it is recommendable that reference is made to U.S. Pat. Nos. 4,463,359 and 4,345,262 each of which discloses an acceptable shape of each pulse. In addition, when the conditions as disclosed in U.S. Pat. No. 4,313,124 are employed in operative association with a temperature elevation rate of the heating portion of the ink jet head, each recording operation can be achieved with more excellent results.

With respect to the structure of the ink jet head, it is recommendable that reference is made to U.S. Pat. Nos. 4,558,333 and 4,459,600 each of which discloses the technical concept that the heating portion of the ink jet head is disposed in the bent region thereof, in addition to the combined structure made among ejection ports, liquid passages (linearly extending liquid passages or liquid passages extending at a right angle relative to two liquid passage portions thereof) and electrothermal transducers as disclosed in the official gazettes of the first-mentioned U.S. patents. It should be noted that the technical concept disclosed in the foregoing prior inventions is involved in the present invention.

In addition, with respect to the structure of a plurality of electrothermal transducers, it is recommendable to reference is made not only to Japanese Patent Application Laying- Open No. 59-123,670 which discloses the structure that a common slit serves as an ejecting portion of each electrothermal transducer but also to Japanese Patent Application Laying-Open No. 59-138,461 which discloses the structure that an opening portion for absorbing a series of pressure waves induced by the thermal energy is formed corresponding to the ejecting portion so as to allow the ink jet head of the present invention to be constructed with advantageous effects.

Additionally, the present invention is advantageously applicable to a so-called full-line type recording head having a width corresponding to a maximum recording width. This type of recording head may be constructed such that the whole length of the recording head is composed of a plurality of recording heads to be combined with each other. Alternatively, the recording head may be constructed such that the whole length of the recording head is composed of a length of a single recording head designed in an integral structure.

Further, the present invention is advantageously applicable to an exchangeable tip type ink jet head constructed such that it can electrically be connected to a main body of the ink jet apparatus, and moreover, ink can be fed to the ink jet head from the main body of the ink jet head. Further, the present invention is likewise advantageously applicable to a cartridge type ink jet head integrated with an ink reservoir.

In each of the aforementioned embodiments of the present invention, description has been made on the assumption that ink to be ejected from the ink jet head is prepared in the form of a liquid. Alternatively, the ink may be prepared such that it is kept solid at a room temperature or at a temperature lower than the room temperature but it is softened or liquidized at the room temperature or less. Since the temperature of the ink is usually controlled in conformity with the ink jet recording system such that the viscosity of the ink is maintained within the stable ink ejecting range by properly regulating the temperature of the ink itself within the range of 30° C. or more to 70° C. or less, the ink may be prepared such that it is kept liquid when a recording operation start command signal is inputted into the ink jet head.

In addition, to prevent the temperature of the ink from being excessively raised up in excess of a predetermined temperature by utilizing the thermal energy for changing the solid state of the ink to the liquid state of the same or to prevent the ink from being vaporized, it is preferable that the ink is prepared such that it is kept solid while it is not practically used. At any rate, the present invention can be applied to the case that ink is liquidized on receipt of the thermal energy in response to a recording operation start command signal so as to allow liquid ink to be ejected from the recording head or the case that each ink droplet starts to be solidified when it is shot onto a recording medium.

Further, according to the present invention, it is acceptable that the ink jet apparatus is practically used as an image output terminal apparatus for an information processing device such as a word processor, a computer or the like. Additionally, the ink jet apparatus may be constructed in the type of a copying machine electrically combined with an optical reader or a facsimile apparatus having a signal sending/receiving function.

While the present invention has been described above with respect to a few preferred embodiments thereof, it should of course be understood that the present invention should not be limited only to these embodiments but various changes or modification may be made without departure from the scope of the present invention as defined by the appended claims.

What is claimed is:

1. In an ink jet head including plural groups of ejecting ports, each having a different flow rate coefficient, which are subjected to a suction recovery operation, the improvement wherein:

an ink capacity of a first ink path communicated with a group of ejecting ports having a first flow rate coefficient is smaller than an ink capacity of a second ink path communicated with a group of ejecting ports having a second flow rate coefficient which is larger than said first flow rate coefficient, said flow rate coefficients differing from each other depending upon a difference in cross-sectional area of each ejecting port involved in each of said plural groups of ejecting ports, wherein, the first ink path and the second ink path have respective capacities so that, when said plural groups of ejecting ports are commonly subjected to a suction pressure, different amounts of ink contained in the first ink path and second ink path are sucked out integrally from said respective ink paths and expulsions of the different amounts of ink by suction are completed at a substantially same timing, and wherein each of said plural groups of ejecting ports ejects a different kind of ink.

2. An ink jet head as claimed in claim 1, wherein said different kind of ink exhibits a different kind of color.

3. An ink jet head as claimed in claim 1, wherein said different kind of ink exhibits different depth of color.

4. In an ink jet head including plural groups of ejecting ports each having a different flow rate coefficient, which are subjected to a suction recovery operation, the improvement wherein;

an ink capacity of a first ink path communicated with a group of ejecting ports having a first flow rate coefficient is smaller than an ink capacity of a second ink path communicated with a group of ejecting ports having a second flow rate coefficient which is larger than said first flow rate coefficient, said flow rate coefficients differing from each other depending upon a difference in cross-sectional area of each ejecting port involved in each of said plural groups of ejecting ports, wherein the first ink path and the second ink path have respective capacities so that, when said plural groups of ejecting ports are commonly subjected to a suction pressure, different amounts of ink contained in the first ink path and second ink path are sucked out integrally from said respective ink paths and expulsion of the different amounts of ink by suction are completed at a substantially same timing, and wherein each of said ink paths includes a common ink chamber communicated with ejecting ports involved in each of said plural groups of ejecting ports, and a plurality of ink flow paths to which ink is fed from each of said common ink chambers.

5. An ink jet head as claimed in claim 1, wherein said ink jet head includes thermal energy generating means for generating thermal energy to be utilized for ejection of ink from said plural groups of ejecting ports.

6. An ink jet head as claimed in claim 5, wherein said thermal energy generating means induces a phenomenon of film boiling in ink.

7. An ink jet head as claimed in claim 5, wherein said thermal energy generating means is comprised of an electrothermal transducer.

8. An ink jet head as claimed in claim 1, wherein an ink reservoir from which ink is fed to said ink path is integrated with said ink jet head.

9. An ink jet head as claimed in claim 1, wherein an ink reservoir from which ink is fed to said ink path is arranged so as to be separated from said ink jet head.

10. In an ink jet apparatus, the improvement comprising:

an ink jet head including plural groups of ejecting ports each having a different flow rate coefficient in such a manner that an ink capacity of a first ink path communicated with a group of ejecting ports having a first flow rate coefficient is smaller than an ink capacity of a second ink path communicated with a group of ejecting ports having a second flow rate coefficient which is larger than said first flow rate coefficient; and sucking means arranged for sucking ink from said plural groups of ejecting ports in a state that the plural groups of ejecting ports are fully covered with a common recovering cap, wherein said flow rate coefficients differ from each other depending upon a difference in cross-sectional area of each ejecting port involved in each of said plural groups of ejecting ports, wherein, the first ink path and the second ink path have respective capacities so that, when said plural groups of ejecting ports are commonly subjected to a suction pressure, different amounts of ink contained in the first ink path and second ink path are sucked out integrally from said respective ink paths and expulsions of the different amounts of ink by suction are completed at a substantially same time, and wherein each of said plural groups of ejecting ports ejects a different kind of ink.

11. An ink jet apparatus as claimed in claim 10, wherein said different kind of ink exhibits a different kind of color.

12. An ink jet apparatus as claimed in claim 10, wherein said different kind of ink exhibits different depth of color.

13. In an ink jet apparatus, the improvement comprising;

an ink jet head including plural groups of ejecting ports each having a different flow rate coefficient in such a manner that an ink capacity of a first ink path communicated with a group of ejecting ports having a first flow rate coefficient is smaller than an ink capacity of a second ink path communicated with a group of ejecting ports having a second flow rate coefficient which is larger than said first flow rate coefficient; and sucking means arranged for sucking ink from said plural groups of ejecting ports in a state that the plural groups of ejecting ports are fully covered with a common recovering cap, wherein said flow rate coefficients differ from each other depending upon a difference in cross-sectional area of each ejecting port involved in each of said plural groups of ejecting ports, wherein the first ink path and the second ink path have respective capacities so that, when said plural groups of ejecting ports are commonly subjected to a suction pressure, different amounts of ink contained in the first ink path and second ink path are sucked out integrally from said respective ink paths and expulsions of the different amounts of ink by suction are completed at a substantially same time, and wherein each of said ink paths includes a common ink chamber communicated with ejecting ports involved in each of said plural groups of ejecting ports, and a plurality of ink flow paths to which ink is fed from each of said common ink chambers.

14. An ink jet apparatus as claimed in claim 10, wherein said ink jet apparatus includes thermal energy generating means for generating thermal energy to be utilized for ejection of ink from said plural groups of ejecting ports.

15. An ink jet apparatus as claimed in claim 14, wherein said thermal energy generating means induces a phenomenon of film boiling in ink.

16. An ink jet apparatus as claimed in claim 14, wherein said thermal energy generating means is comprised of an electrothermal transducer.

17. An ink jet apparatus as claimed in claim 10, wherein an ink reservoir from which ink is fed to said ink path is integrated with an ink jet head installed in said ink jet apparatus.

18. An ink jet apparatus as claimed in claim 10, wherein an ink reservoir from which ink is fed to said ink path is arranged so as to be separated from an ink jet head installed in said ink jet apparatus.

19. An ink jet apparatus as claimed in claim 10, wherein said common recovering cap includes partitioning means for partitioning a group of ejecting ports having a different flow rate coefficient from each other.

20. In a method recoverably activating an ink jet apparatus having an ink jet head including plural groups of the ejecting ports each having a different flow rate coefficient so that an ink capacity of a first ink path communicated with a group of ejecting ports having a first flow rate coefficient is smaller than an ink capacity of a second ink path communicated with a group of ejecting ports having a second flow rate coefficient which is larger than said first flow rate coefficient, all said plural groups of ejecting ports being subjected to ejection recovering treatment by utilizing pressure applied to said ejecting ports, the improvement comprising the steps of:

discharging ink remaining in a region extending from said plural groups of ejecting ports to predetermined positions in a plurality of ink paths communicated with said plural groups of ejecting ports; and allowing ink located at said predetermined positions in said plurality of ink paths to be dislocated to discharging positions of said ink so that ink at said predetermined positions in each of said plurality of ink paths positionally coincides with said discharging positions in a substantially same timing relationship after said ejection recovering treatment starts to be conducted, wherein said flow rate coefficients differ from each other depending upon a difference in cross-sectional area of each ejecting port involved in each of said plural groups of ejecting ports, wherein, when the plural groups of ejecting ports are commonly subjected to ejection recovering treatment, different amounts of ink contained in the first ink path and second ink path are sucked out integrally from said respective ink paths and expulsions of the different amounts of ink by suction are completed at a substantially same time, and wherein each of said plural groups of ejecting ports ejects a different kind of ink.

21. A method of recoverably activating an ink jet apparatus as claimed in claim 20, wherein said different kind of ink exhibits a different kind of color.

22. A method of recoverably activating an ink jet apparatus as claimed in claim 20, wherein said different kind of ink exhibits different depth of color.

23. A method of recoverably activating an ink jet apparatus as claimed in claim 20, wherein said ejection recovering treatment is conducted by suction treatment in a capped state where all of said plural groups of ejecting ports are fully capped with a common recovering cap.

24. In a method recoverably activating an ink jet apparatus having an ink jet head including plural groups of the ejecting ports each having a different flow rate coefficient so that an ink capacity of a first ink path communicated with a group of ejecting ports having a first flow rate coefficient is smaller than an ink capacity of a second ink path communicated with a group of ejecting ports having a second flow rate coefficient which is larger than said first flow rate coefficient, all said plural groups of ejecting ports being subjected to ejection recovering treatment by utilizing pressure applied to said ejecting ports, the improvement comprising the steps of:

discharging ink remaining in a region extending from said plural groups of ejecting ports to predetermined positions in a plurality of ink paths communicated with said plural groups of ejecting ports; and allowing ink located at said predetermined positions in said plurality of ink paths to be dislocated to discharging positions of said ink so that ink at said predetermined positions in each of said plurality of ink paths positionally coincides with said discharging positions in a substantially same timing relationship after said ejection recovering treatment starts to be conducted, wherein said flow rate coefficients differ from each other depending upon a difference in cross-sectional area of each ejecting port involved in each of said plural groups of ejecting ports, wherein, when the plural groups of ejecting ports are commonly subjected to ejection recovering treatment, different amounts of ink contained in the first ink path and second ink path are sucked out integrally from said respecting ink paths and expulsions of the different amounts of ink by suction are completed at a substantially same time, and wherein each of said ink paths includes a common ink chamber communicated with ejecting ports involved in each of said plural groups of ejecting ports, and a plurality of ink flow paths to which ink is fed from each of said common ink chambers.

25. A method of recoverably activating an ink jet apparatus as claimed in claim 24, wherein said predetermined positions in said ink paths are positionally coincident with joint portions between said common ink chambers and said ink feeding paths.

26. A method of recoverably activating an ink jet apparatus as claimed in claim 24, wherein said predetermined positions in said ink path are positionally coincident with joint portions between said ink feeding paths and an ink reservoir from which ink is fed to said ink paths.

27. An ink jet head comprising:

plural groups of ejecting ports, each group communicating with a respective ink path containing an amount of ink, wherein said ink paths have respective capacities to contain different amounts of ink so that, when said plural groups of ejecting ports are commonly subjected to a suction pressure, the different amounts of ink contained in the respective ink paths are sucked out integrally from said respective ink paths and expulsions of the different amounts of ink by suction are completed at a substantially same timing, and wherein each of said plural groups of ejecting ports ejects a different kind of ink.

28. An ink jet head comprising:

plural groups of ejecting ports, each group communicating with a respective ink path containing an amount of ink, wherein said ink paths have respective capacities to contain different amounts of ink so that, when said plural groups of ejecting ports are commonly subjected to a suction pressure, the different amounts of ink contained in the respective ink paths are sucked out integrally from said respective ink paths and expulsions of the different amounts of ink by suction are completed at a substantially same timing, and wherein each of said ink paths includes a common ink chamber communicated with ejecting ports involved in each of said plural groups of ejecting ports, and a plurality of ink flow paths to which ink is fed from each of said common ink chambers.

* * * * *